US005105176A

United States Patent [19]

Okamura et al.

[11] Patent Number: 5,105,176

[45] Date of Patent: * Apr. 14, 1992

[54] DIELECTRIC RESONATOR AND A MANUFACTURING METHOD THEREOF

[75] Inventors: Hisatake Okamura; Teruhisa Tsuru; Tetsuo Taniguchi; Ken Tonegawa, all of Kyoto, Japan

[73] Assignee: Murata Manufacturing Co., Ltd., Nagaokakyo, Japan

[ * ] Notice: The portion of the term of this patent subsequent to Dec. 24, 2008 has been disclaimed.

[21] Appl. No.: 567,581

[22] Filed: Aug. 15, 1990

[30] Foreign Application Priority Data

Aug. 16, 1989 [JP] Japan ..... 1-211135

[51] Int. Cl.[5] ..... H03H 5/02

[52] U.S. Cl. ..... 333/219; 333/185

[58] Field of Search ..... 333/219, 219.1, 204, 333/184, 185, 174, 180; 361/321, 308; 336/200

[56] References Cited

U.S. PATENT DOCUMENTS 3,701,958 10/1972 Jaag ..... 333/185
4,614,925 9/1986 Kane ..... 333/185 X
4,916,582 4/1990 Okamura et al. ..... 361/321
4,918,570 4/1990 Okamura et al. ..... 361/321

*Primary Examiner*—Eugene R. Laroche
*Assistant Examiner*—Seung Ham
*Attorney, Agent, or Firm*—Armstrong, Nikaido, Marmelstein, Kubovcik & Murray

[57] ABSTRACT

A dielectric resonator for surface mounting comprising two dielectric layers; a conductive layer formed on a plane interposed between the two dielectric layers, the conductive layer being lengthy and having an inductance determined by a length thereof; grounding electrode layers provided on outer surfaces of the two dielectric layers; protective layers for covering outer surfaces of the grounding electrode layers; a first outer connecting terminal provided on a surface of a main body of the resonator and electrically connected to an end of the conductive layer and to the grounding electrode layers, the main body comprising the protective layers, the dielectric layers, the conductive layer and the grounding electrode layers; and a second connecting terminal provided on a surface of the main body and electrically connected to a portion of the conductive layer, the portion being far from the above end of the conductive layer.

9 Claims, 6 Drawing Sheets

DIELECTRIC RESONATOR AND A MANUFACTURING METHOD THEREOF

BACKGROUND OF THE INVENTION (1) Field of the Invention

This invention relates to a dielectric resonator mainly for use in a portable transceiver in a frequency range of several hundred megahertz to several gigahertz and a manufacturing method thereof (2) Description of the Prior Art Among known resonators used in a frequency range of several hundred megahertz to several gigahertz are a dielectric resonator which has been proposed by the inventors of this invention (illustrated in FIGS. 1*a*, 1*b* and 1*c*) and a helical resonator shown in FIG. 3.

FIG. 1*a* is a front view of the dielectric resonator, FIG. 1*b* is a side view thereof, and FIG. 1*c* is a rear view thereof. In these figures, a dielectric plate 51 formed of FROR or the like has an upper surface 51*a* and a lower surface 51*b*. A set of capacitor electrodes 52*a* and 52*b* and another set of capacitor electrodes 53*a* and 53*b* are formed on the upper and the lower surfaces 51*a* and 51*b*, respectively. An inductor electrode 54*a* is formed on the upper surface 51*a* to connect 52*a* and 52*b*, and another inductor electrode 55*a* is formed on the lower surface 51*b* to connect 53*a* and 53*b*. The above electrodes are formed by screen-printing a silver paste on the surfaces.

The above two sets of electrodes are opposed to each other with the dielectric plate 51 therebetween, thereby forming capacitors C1 and C2, whose capacitances depend on the dielectric constant and the thickness of the dielectric plate 51 and on the surface area where the one of the sets oppose the other.

FIG. 2 is an equivalent circuit of the dielectric resonator, where L1 and L2 indicate inductors formed by the inductor electrodes 54*a* and 55*a*, respectively. In FIG. 2, an LC series circuit consisting of the capacitor C1 and inductors L1 and L2 connected to both ends thereof is connected to the capacitor C2 in parallel.

FIG. 3 shows the above-mentioned helical resonator, in which a helical coil 21 wound around the insulating cylinder 23 is cased in a metal container 22. An inductance of the helical coil 21 and a capacitance formed between the helical coil 21 and the metal container 22 constitute an LC resonator.

Both the dielectric resonator of FIG. 1 and the helical resonator of FIG. 3 have problems. The former needs a shield due to its vulnerability to the outer electromagnetic field. However, the fact that the shield should be a metal plate and should be provided a specified distance away from the capacitor electrodes and the inductor electrodes inevitably increases the size of the resonator.

In the latter, the metal container 22 acts as a shield. However, the helical resonator is difficult to be compact and is not suitable for surface mounting.

SUMMARY OF THE INVENTION

Accordingly, it is an object of this invention to provide a dielectric resonator which is compact and is suitable for surface mounting.

It is another object of this invention to provide a dielectric resonator in which a composing element of an LC resonator functions as a shield.

The above objects are fulfilled by a dielectric resonator for surface mounting comprising two dielectric layers; a conductive layer formed on a plane interposed between the two dielectric layers, the conductive layer being lengthy and having an inductance determined by a length thereof; grounding electrode layers provided on outer surfaces of the two dielectric layers; protective layers for covering outer surfaces of the grounding electrode layers; a first outer connecting terminal provided on a surface of a main body of the resonator and electrically connected to an end of the conductive layer and to the grounding electrode layers, the main body comprising the protective layers, the dielectric layers, the conductive layer and the grounding electrode layers; and a second outer connecting terminal provided on a surface of the main body and electrically connected to a portion of the conductive layers, the portion being far from the above end of the conductive layer.

The grounding electrode layers each may have such a shape that substantially cover the conductive layer.

The conductive layer may be spiral on the above plane.

The conductive layer may be winding on the above plane.

The conductive layer may be extended from the above end and the above portion to be exposed as a first exposed part and a second exposed part on a side surface of the main body, and the grounding electrode layers may be extended to be exposed as a third exposed part and a fourth exposed part on a side surface of the main body.

The conductive layer may be spiral, the above end may be an outermost end thereof, and the above portion may belongs to an outermost periphery of the conductive layer.

The first connecting terminal may be connected to the first, the third and the fourth exposed parts, and the second connecting terminal may be connected to the second exposed part.

The main body may be a rectangular parallelopiped in which the first, the second, the third and the fourth exposed parts may be provided on a same side surface.

The first, the third and the fourth exposed parts may be stacked upright on the side surface, and the second exposed part may be off a vertical line connecting the first, the third and the fourth exposed parts.

According to the above constructions, a conductive layer forms an inductor. Since a dielectric layer is interposed between the conductive layer and a grounding electrode layer, a capacitor is formed therebetween. Therefore, the resonator according to this invention is equivalently the same with the helical resonator. In the former case, however, its flat construction makes itself suitable for surface mounting and the feature of the grounding electrode layer of acting as a shield eliminates the trouble of adding another shield.

Generally in an LC resonator, lowering the resonating frequency requires an inductance or a capacitance to be increased, which would enlarge the size of the resonator. According to this invention, on the contrary, a capacitance is increased by thinning the dielectric layer interposed between the conductive layer and the grounding electrode layer. In other words, lowering the resonating frequency means reducing the size of the resonator.

A resonator having the above construction is obtained by a manufacturing method of a dielectric resonator for surface mounting, the method comprising the steps of obtaining a main body wherein a first protective layer, a first grounding electrode layer, a first dielectric layer, a conductive layer, a second dielectric layer, a second grounding electrode layer and a second protective layer exists vertically in this order and pressure-adhering the above layers to produce a laminated body; printing a first outer connecting terminal and a second outer connecting terminal on a side surface of the laminated body, the first outer connecting terminal being connected with an end of the conductive layer and the first and the second grounding electrode layers, and the second outer connecting terminal being connected with a portion of the conductive layer, the portion being far from the above end; and firing the laminated body with the outer connecting terminals printed thereon.

The main body may be obtained by preparing unbaked dielectric sheets having the same thickness in quantities, forming the grounding electrode layers each on a first and a second of the sheets and forming the conductive layer on a third of the sheets, and laminating these three sheets and the remaining sheets in a specified order.

The first and the second dielectric layers may be obtained by use of dielectric blocks each having a specified thickness.

The main body may be obtained by use of the first protective sheet having the first grounding electrode layer formed on an upper surface thereof, the first dielectric layer having the conductive layer formed on an upper surface thereof, and the second dielectric layer having the second grounding electrode layer formed on an upper surface thereof.

BRIEF DESCRIPTION OF THE DRAWINGS

These and other objects, advantages and features of the invention will become apparent from the following description thereof taken in conjunction with the accompanying drawings which illustrate specific embodiments of the invention. In the drawings.

DESCRIPTION OF THE PREFERRED EMBODIMENTS

Figure 1A:
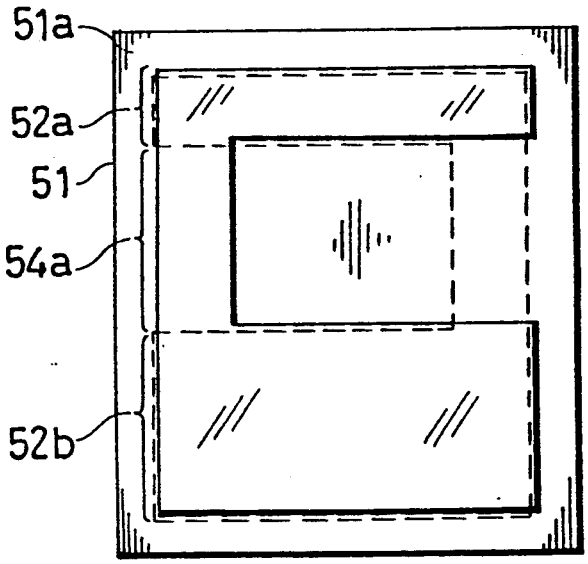
Fig. 1a PRIOR ART
FIGS. 1*a*, 1*b* and 1*c* are front, side and rear views of a conventional dielectric resonator.
Figure 1B:
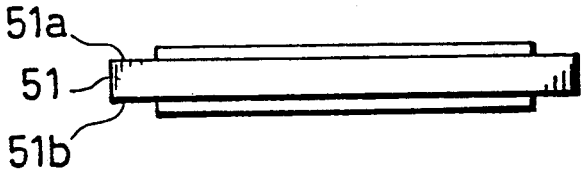
Fig. 1b PRIOR ART
Figure 1C:
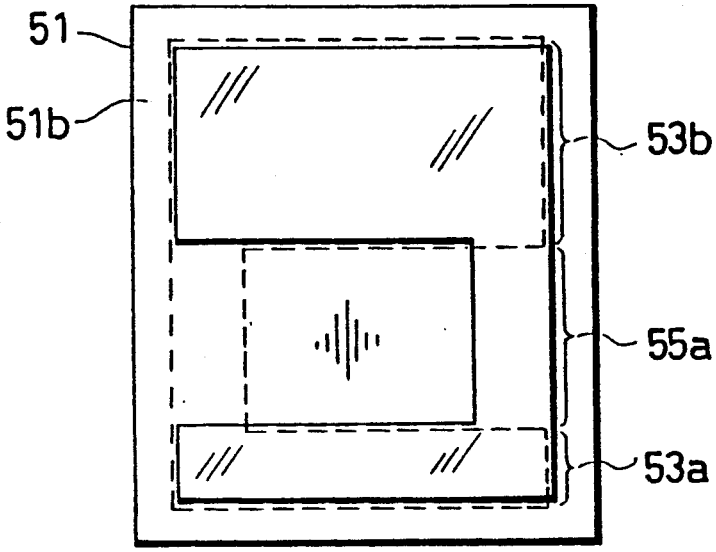
Fig. 1c PRIOR ART
Figure 2:
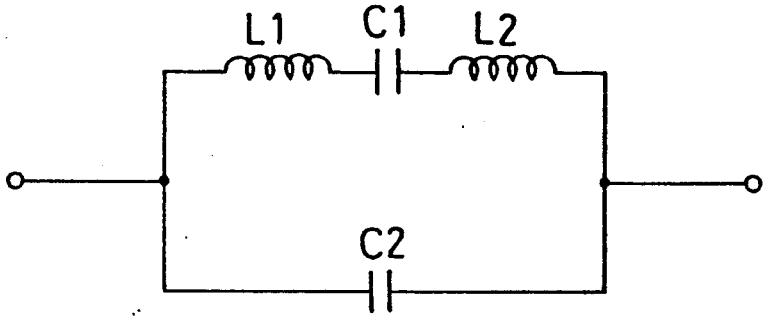
FIG. 2 is an equivalent circuit of the same.
Figure 3:
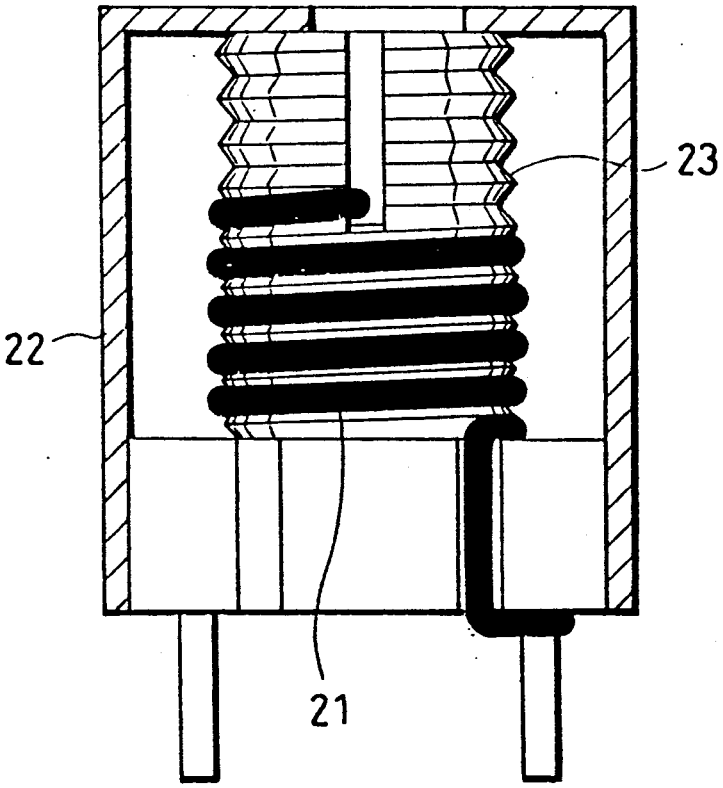
Fig. 3 PRIOR ART
FIG. 3 is a cross sectional view of another conventional resonator.
Figure 4:
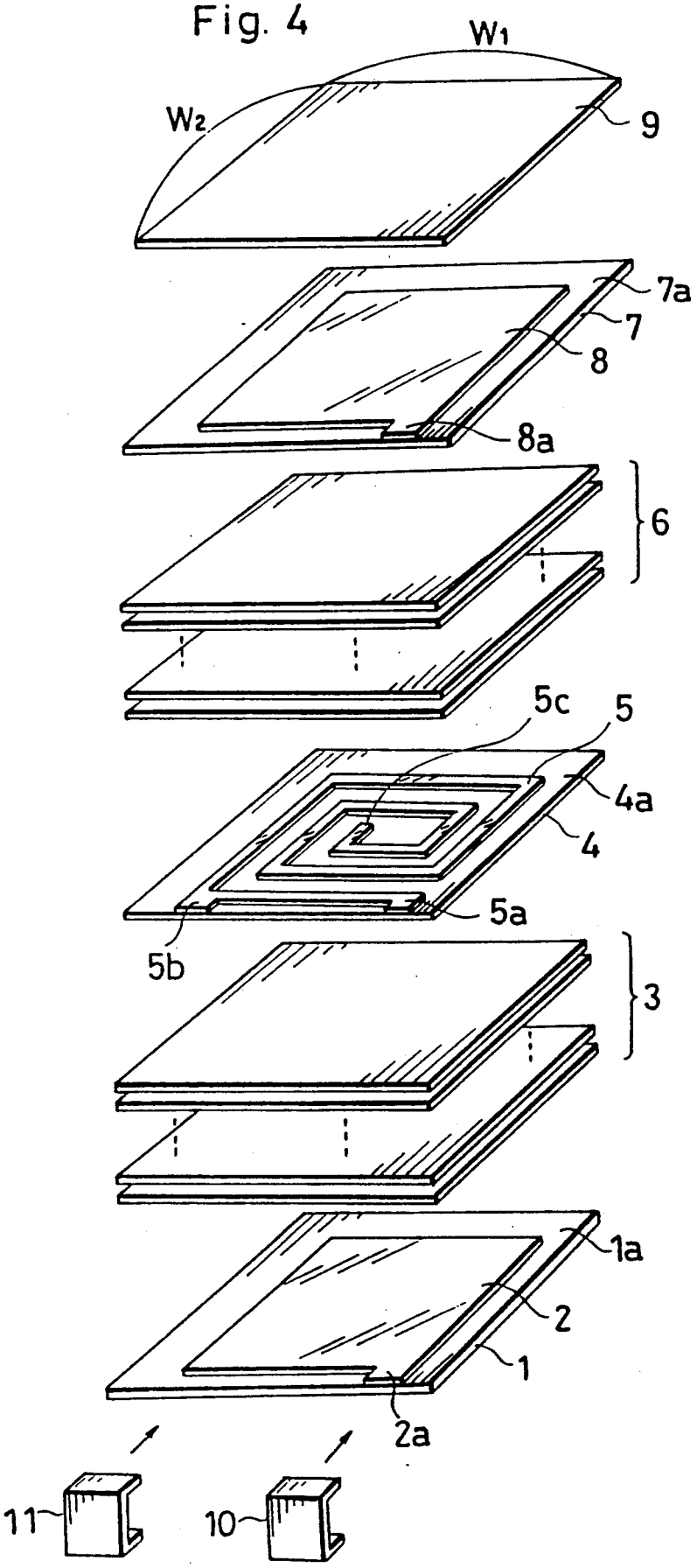
FIG. 4 is an exploded perspective view of an embodiment according to this invention.

FIG. 4 is an exploded perspective view of a dielectric resonator as an embodiment of this invention, and FIG. 5 is a front view of the same.

The dielectric resonator comprises a first dielectric sheet 1 having a film-like grounding electrode 2 formed on an upper surface thereof, a first dielectric layer 3 laminated on the first dielectric sheet 1, a second dielectric sheet 4 which is laminated on the first dielectric layer 3 and has a substantially spiral conductive film 5 on an upper surface 4*a* thereof, a second dielectric layer 6 laminated on the second dielectric sheet 4, a third dielectric sheet 7 which is laminated on the second dielectric layer 6 and has a film-like grounding electrode 8 on an upper surface 7*a* thereof, and a fourth dielectric sheet 9 laminated on the third dielectric sheet 7. (An assembly of these sheets and layers will be referred to as a laminated body.) The resonator further comprises two outer connecting terminals 10 and 11 formed on a surface of the laminated body. Connected to the terminal 10 are an end 5*a* of the conductive film 5 and portions 2*a* and 8*a* of the grounding electrodes 2 and 8. Connected to the terminal 11 is a portion 5*b* of the conductive film 5, the portion 5*b* far from the end 5*a*.

The dielectric layers 3 and 6 comprises a multiplicity of dielectric sheets laminated one on another, and all these dielectric sheets and the dielectric sheets 1, 4, 7 and 9 have the same thickness (for instance, 40μm), in order to avoid the trouble of preparing sheets of different thicknesses. As will be described later, the thicknesses of the dielectric layers 3 and 6 determine capacitances between the conductive film 5 and the grounding electrodes 2 and 8. Accordingly, the capacitances can be adjusted by the number of the dielectric sheets used to form the layers 3 and 6. The sheets 1 and 9, which are provided for preventing the grounding electrodes 2 and 8 from being scratched and from contacting a conductive land on a printed circuit board when the resonator is mounted on the board, are not necessarily required to be dielectric.

The grounding electrodes 2 and 8 and the conductive film 5 are formed by screen-printing a conductive material such as Ag and Cu.

The inductance of the conductive film 5 is determined by its total length from the end 5*a* to another end 5*c*.

Figure 5A:
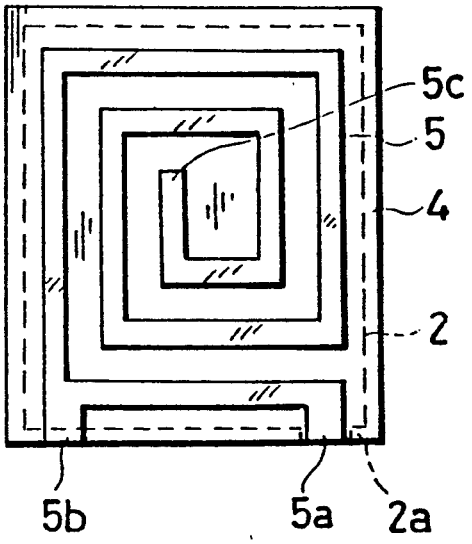
FIGS. 5*a* and 5*b* are views indicating the relationship between a conductive film and film-like grounding electrodes of the same.
Figure 5B:
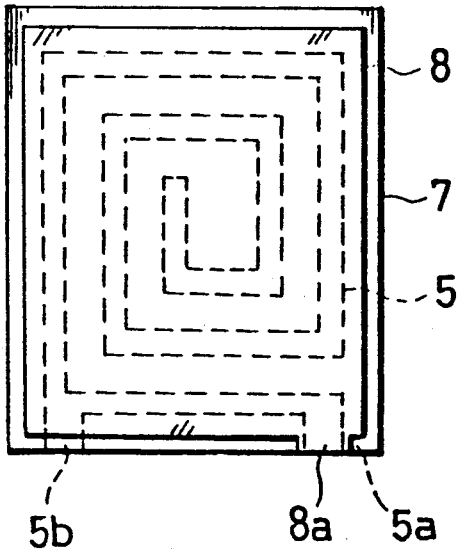

The grounding electrodes 2 and 8, which are provided for grounding the conductive film 5, has a surface area large enough to totally cover the conductive film 5 as shown in FIGS. 5*a* and 5*b*. The conductive film 5 is opposed to the grounding electrodes 2 and 8 with the dielectric layers 3 and 7 therebetween, wherein capacitors are formed between the conductive film 5 and the grounding electrodes 2 and 8. The capacitances of the capacitors depend on (1) the surface areas where the film 5 is opposed to the electrodes 2 and 8 (will be referred to as opposing surface areas, hereinafter), (2) the distances between the film 5 and the electrodes 2 and 8, namely the thicknesses of the layers 3 and 7, and (3) the dielectric constant of the layers 3 and 7.

Figure 6:
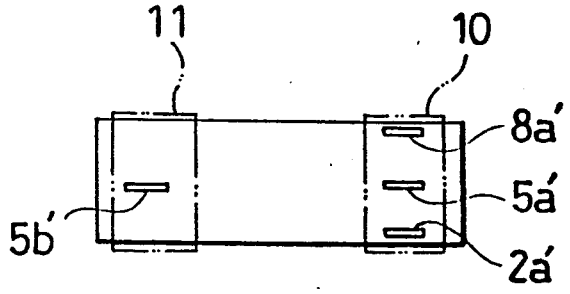
FIG. 6 is a front view of the same.

The conductive film 5 is extended both from the end 5*a* and the portion 5*b* to be exposed as exposed parts 5*a*' and 5*b*' on a side surface of the laminated body. The grounding electrodes 2 and 8 are also extended from the C portions 2*a* and 8*a* to be exposed as exposed parts 2*a*' and 8*a*' on the side surface. As shown in FIG. 6, the parts 2*a*', 5*a*' and 8*a*' are stacked upright. On the other hand, the part 5*b*' is off the vertical line connecting the parts 2*a*', 5*a*' and 8*a*'.

The terminal 10 is formed on the side surface of the laminated body so that it cover the parts 2*a*', 5*a*' and 8*a*'. The terminal 11 is formed on the side surface so that it cover the part 5*b*'.

In this embodiment, the laminated body is a rectangular parallelopiped. Since the parts 2*a*', 5*a*', 5*b*' and 8*a*' are formed on the same surface, the terminals 10 and 11 can be printed at a time.

Figure 7:
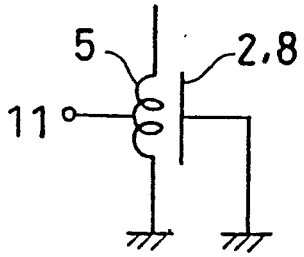
FIG. 7 is an equivalent circuit of the same.

The resonator has an equivalent circuit as shown in FIG. 7, where the end 5*a* of the conductive film 5 and the grounding electrodes 2 and 8 are grounded.

Figure 8:
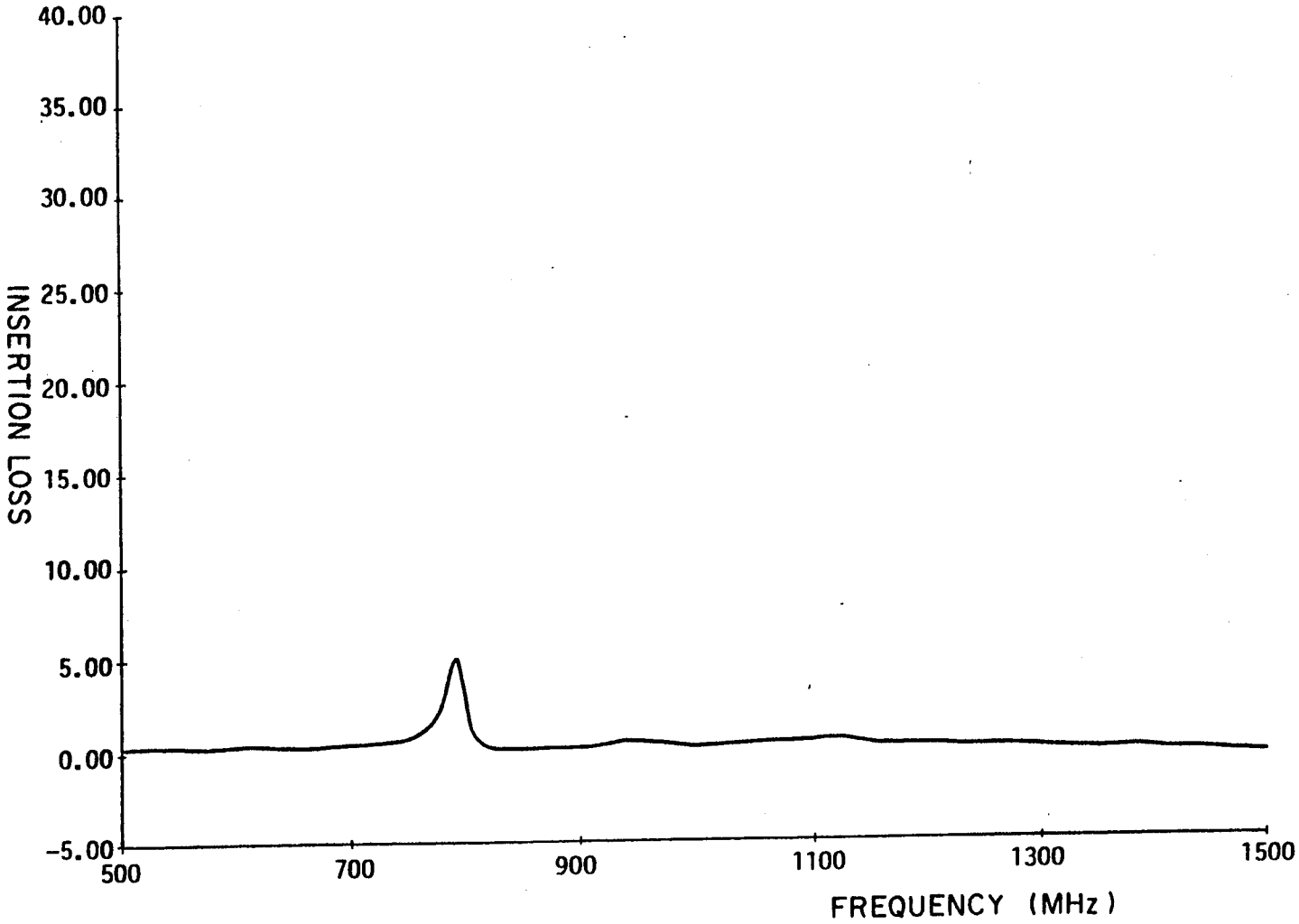
FIG. 8 is a graph showing a frequency characteristic of the same.

As mentioned before, the capacitances of the capacitors formed between the conductive film 5 and the grounding electrodes 2 and 8 depend on the distances between the film 5 and the electrodes 2 and 8. More specifically, reducing the distances increases the capacitances and thus lowers the resonating frequency. An experiment has confirmed that the frequency range which this resonator is applied to can be several hundred megahertz to several gigahertz by adjusting the dielectric constants and the thicknesses of the dielectric layers 3 and 7 and the opposing surface area of the conductive film 5 and the layers 3 and 7. FIG. 8 shows an example of the frequency characteristic. This characteristic is obtained when the dielectric layers 3 and 7 each have a thickness of 300 μm and the resonator has a length $W_1$ (FIG. 4) of 5 mm and a width $W_2$ of 5.7 mm.

A resonator having the above construction is produced in the following way.

Unbaked dielectric greensheets are prepared in quantities, and a conductive paste is printed on the three of them. The dielectric greensheets with the conductive paste printed thereon and those without the conductive paste are laminated as shown in FIG. 4 and is pressure-adhered into a laminated body. Then, a conductive paste is printed on specified parts of a specified side surface of the laminated body as the terminals 10 and 11. Finally, the laminated body is fired, whereby the pressure-adhering of the laminated body is secured and the conductive paste on the dielectric sheets is baked as the conductive film 5 and the grounding electrodes 2 and 8.

As for mounting, the resonator, thanks to its flat shape, is easy to put on the printed circuit board. With the terminals 10 and 11 being provided at appropriate positions, the terminals 10 and 11 can easily be soldered with the conductive land of the board, thereby realizing surface mounting.

In this embodiment, the dielectric layers 3 and 4 each comprise a multiplicity of thin sheets laminated one on another. However, a dielectric plate having a specified thickness can also be used as a dielectric layer.

Instead of producing the resonators one by one, the following method is employable. A conductive paste is formed on a large dielectric greensheet, at a lot of positions, and also on two more large dielectric greensheets, at the same number of positions for each. Then, the three dielectric greensheets are laminated and cut into units to produce laminated bodies, and the bodies are fired. According to this method, it is easier to expose the conductive film and the grounding electrodes on a side surface of the laminated body, and also mass production is realized if the laminated greensheets are cut at appropriate positions.

Figure 9:
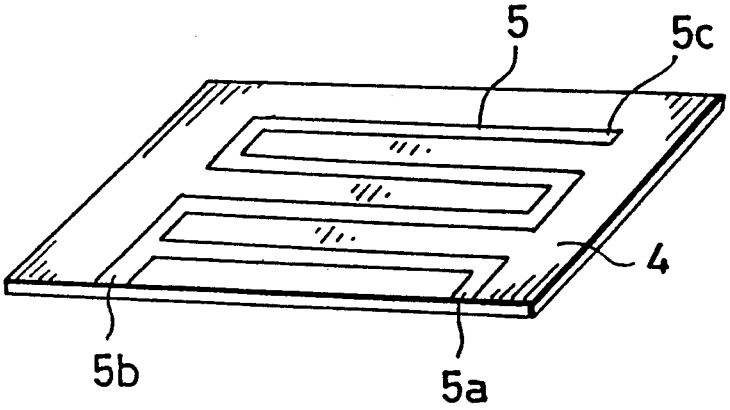
FIG. 9 is a perspective view of another embodiment according to this invention.

FIG. 9 is a perspective view of another embodiment of the conductive film 5. The conductive film 5 is winding and formed on the dielectric sheet 4. In this embodiment, as in FIG. 5, the conductive film 5 is extended from the end 5*a* and the portion 5*b*. 5*b* can be at any portion which is located between the ends 5*a* and 5*c* and far from the end 5*a*. Further, 5*b* may be the position of 5*c*.

Although the present invention has been fully described by way of embodiments with references to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A dielectric resonator for surface mounting comprising two dielectric layers;

a conductive layer formed on a plane interposed between said two dielectric layers, said conductive layer being lengthy and have an inductance determined by a length thereof;

grounding electrode layers provided on outer surfaces of said two dielectric layers;

protective layers for covering outer surfaces of said grounding electrode layers;

a first outer connecting terminal provided on a surface of a main body of said resonator and electrically connected to an end of said conductive layer and to said grounding electrode layers, said main body of said resonator includes said protective layers, said dielectric layers, said conductive layer and said grounding electrode layers; and a second outer connecting terminal provided on a surface of the main body and electrically connected to a portion of said conductive layers, the portion being far from said end of said conductive layer.

2. A dielectric resonator of claim 1, wherein each of said grounding electrode layers has a shape such that each substantially covers said conductive layer.

3. A dielectric resonator of claim 2, wherein said conductive layer is spiral on said plane interposed between said two dielectric layers.

4. A dielectric resonator of claim 2, wherein said conductive layer is winding on said plane interposed between said two dielectric layers.

5. A dielectric resonator of claim 1, wherein said conductive layer extends from said end and said portion of said conductive layer to the exposed as a first exposed part and a second exposed part on a side surface of said main body, and wherein said grounding electrode layers are extended to be exposed a third exposed part and a fourth exposed part on said side surface of said main body.

6. A dielectric resonator of claim 5, wherein said conductive layer is spiral, wherein said end of said conductive layer is an outermost end thereof, and said portion of said conductive layer belongs to an outermost periphery of said conductive layer.

7. A dielectric resonator of claim 5, wherein said first connecting terminal is connected to said first exposed part, said third exposed part and said fourth exposed part, and wherein said second connecting terminal is connected to said second exposed part.

8. A dielectric resonator of claim 7, wherein said main body is a rectangular parallelopiped in which said first exposed part, said second exposed part, said third exposed part, and said fourth exposed part are provided on a same side surface.

9. A dielectric resonator of claim 8, wherein said first exposed part, said third exposed part and said fourth exposed part are stacked upright on said side surface, and said second exposed part is off from a vertical line connecting said first exposed part, said third exposed part and said fourth exposed part.

* * * * *